US009398800B2

(12) United States Patent
Uehara et al.

(10) Patent No.: US 9,398,800 B2
(45) Date of Patent: Jul. 26, 2016

(54) COSMETIC APPLICATION DEVICE

(71) Applicant: Kao Corporation, Chuo-ku (JP)

(72) Inventors: Kazuyuki Uehara, Moka (JP); Kenko Kurita, Tokyo (JP); Masahiro Oka, Matsudo (JP); Yu Saito, Kawasaki (JP)

(73) Assignee: Kao Corporation, Chu-ku (JP)

( * ) Notice: Subject to any disclaimer, the term of this patent is extended or adjusted under 35 U.S.C. 154(b) by 0 days.

(21) Appl. No.: 14/369,505

(22) PCT Filed: Dec. 4, 2012

(86) PCT No.: PCT/JP2012/081370

§ 371 (c)(1),
(2) Date: Jun. 27, 2014

(87) PCT Pub. No.: WO2013/099534

PCT Pub. Date: Jul. 4, 2013

(65) Prior Publication Data

US 2014/0348566 A1 Nov. 27, 2014

(30) Foreign Application Priority Data

Dec. 29, 2011 (JP) ..... 2011-290310
May 29, 2012 (JP) ..... 2012-121766
Sep. 26, 2012 (JP) ..... 2012-212856

(51) Int. Cl.
*A46D 1/00* (2006.01)
*A46D 9/00* (2006.01)
(Continued)

(52) U.S. Cl.
CPC ..... *A45D 34/046* (2013.01); *A45D 34/045* (2013.01); *A45D 40/267* (2013.01); *A45D 2034/007* (2013.01); *A45D 2040/0012* (2013.01); *A45D 2200/053* (2013.01)

(58) Field of Classification Search
CPC ..... A45D 34/046; A46D 1/00; A46B 3/18
USPC ..... 401/122, 126, 212, 121, 129, 130; 132/218
See application file for complete search history.

(56) References Cited

U.S. PATENT DOCUMENTS 6,568,405 B2 * 5/2003 Masuyama ..... A45D 34/048 132/218
D614,347 S 4/2010 Uehara et al.
(Continued)

FOREIGN PATENT DOCUMENTS

CN 1323260 A 11/2001
EP 1 177 741 A 2/2002
(Continued)

OTHER PUBLICATIONS

International Preliminary Report on Patentability and Written Opinion issued Jul. 10, 2014 in PCT/JP2012/081370 (submitting English translation only).
(Continued)

*Primary Examiner* — Mark A Laurenzi
*Assistant Examiner* — Thomas M Abebe
(74) *Attorney, Agent, or Firm* — Oblon, McClelland, Maier & Neustadt, L.L.P.

(57) ABSTRACT

This cosmetic application device (1) includes an application tool (2) and a container (3), the application tool (2) being insertable into and removable from the container (3) through an opening (33) of the container (3). When the application tool (2) is tilted in a state where the fixation between the lid body (23) of the application tool (2) and the mouth/neck section (32) of the container (3) has been released and the lower end section (23*d*) of the lid body (23) is located at a position within the height-wise length of the mouth/neck section (32), the front end of the application section (21) of the application tool (2) is made to contact an inner wall in the vicinity of the bottom section of the containing section (31) of the container (3).

21 Claims, 10 Drawing Sheets

(51) Int. Cl.

| | |
|---|---|
| ***A45D 40/26*** | (2006.01) |
| ***A46B 11/00*** | (2006.01) |
| ***A45D 33/00*** | (2006.01) |
| ***A45D 34/04*** | (2006.01) |
| *A45D 34/00* | (2006.01) |
| *A45D 40/00* | (2006.01) |

(56) References Cited

U.S. PATENT DOCUMENTS

| | | | | |
|---|---|---|---|---|
| D617,045 | S | 6/2010 | Uehara et al. | |
| D628,741 | S | 12/2010 | Uehara et al. | |
| D633,650 | S | 3/2011 | Uehara et al. | |
| 2005/0232681 | A1 | 10/2005 | Gueret | |
| 2006/0013639 | A1 * | 1/2006 | Gueret | A45D 34/045 401/130 |
| 2007/0246058 | A1 | 10/2007 | Bodelin | |
| 2010/0147322 | A1 | 6/2010 | Gueret | |
| 2012/0204899 | A1 | 8/2012 | Uehara et al. | |

FOREIGN PATENT DOCUMENTS

| | | | | |
|---|---|---|---|---|
| JP | 2005-296668 | | | 10/2005 |
| JP | 2007-296331 | | | 11/2007 |
| JP | 2009-153826 | | | 7/2009 |
| JP | 2009-153963 | | | 7/2009 |
| JP | 2009153826 | A | * | 7/2009 |
| JP | 3159188 | | | 5/2010 |
| JP | 2011-1303 | | | 1/2011 |
| JP | 2011-131064 | | | 7/2011 |
| WO | 2011/043470 | A1 | | 4/2011 |

OTHER PUBLICATIONS

Extended European Search Report issued Sep. 9, 2015 in Patent Application No. 12861157.1.

International Search Report issued Jan. 8, 2013, in PCT/JP2012/081370, filed Dec. 4, 2012.

* cited by examiner

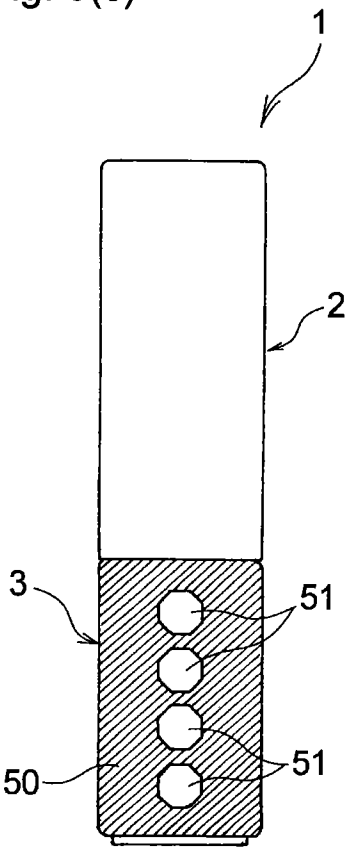
Fig. 8(a)
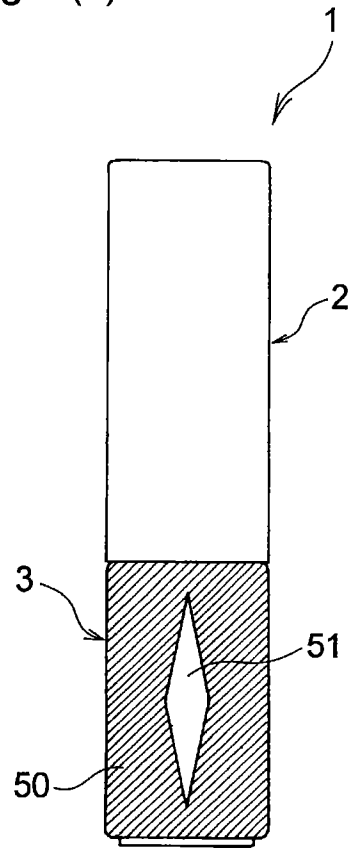
Fig. 8(b)
Fig. 8(c)

COSMETIC APPLICATION DEVICE

CROSS REFERENCE TO RELATED APPLICATION

This application is a continuation of PCT/JP2012/081370, filed on Dec. 4, 2014, and claims priority to the following Japanese applications: 2011-290310, filed on Dec. 29, 2011; 2012-121766, filed on May 29, 2012; and 2012-212856, filed on Sep. 26, 2012.

TECHNICAL FIELD

The present invention relates to a cosmetic application device that is used particularly suitably for applying cosmetics.

BACKGROUND ART

Cosmetics that have a liquid or semi-solid property and that lack shape retainability, such as lipstick, lip gloss, and mascara, are usually used in container-filled form. Containers for containing such types of cosmetics generally include: a slender container body having an opening in one end; a lid body detachably attached to the opening; a support shaft attached to the lid body; and an application section attached to the front end of the support shaft. The application section is insertable into and removable from the container body through the opening of the container body. The fixed state between the container body and the lid body is maintained by screwing or fitting. Upon use, the screwing or fitting is released, and the application section immersed in the cosmetic is taken out from the container body, and the cosmetic is applied by bringing the application section into contact with a section onto which the cosmetic is to be applied.

In a container having such a configuration, when the screwing/fitting between the container body and the lid body is released, the front end of the application section will move away from the bottom section of the container body. Thus, it is difficult to scrape off the small amount of cosmetic remaining at the bottom section of the container body.

With the aim of completely using up the small amount of cosmetic remaining at the bottom section of the container body without waste, Patent Literature 1 proposes a technique in which a rotary bearing section is provided to the opening of the container body, and the lid body is held in a slidingly-tiltable and slidingly-rotatable manner with respect to the opening of the container body. Patent Literature 2 also discloses a cosmetic container having a similar structure.

CITATION LIST

Patent Literature

Patent Literature 1: JP 2009-153826 A

Patent Literature 2: JP 2009-153963 A

In the containers disclosed in Patent Literature 1 and 2, however, the tilting/rotating movement of the lid body cannot be performed simultaneously with the lifting/lowering movement of the lid body. Further, at the time of lifting the lid body, it is difficult to tilt the lid body until the point where the inner wall of the lid body moves completely over the rotary bearing section. Thus, until that point, the cosmetic adhering to the inner wall of the container body cannot be scraped off, and a band-shaped region in which the cosmetic remains will be formed along the circumferential direction of the container body; if the container body is transparent, the remainder will become noticeable from the outside. Further, the lid body tends to gain momentum at the time of moving over the rotary bearing section, and, in reaction thereto, the cosmetic may get splattered and soil the surrounding area. Moreover, the aforementioned container is complicated in structure, is poor in industrial productivity, and may malfunction due to deterioration from aging.

Particularly, semi-solid cosmetics are not only prone to adhere to the inner wall of the container body, but are also prone to remain at the bottom section of the container body and the upper corners thereof. The techniques disclosed in Patent Literatures 1 and 2, however, provide no countermeasure for scraping off cosmetics remaining in the upper corners. In order to scrape off cosmetics adhering to the upper corners of a container body, it is necessary to shallowly insert the application section into the container body while tilting the support shaft to a great extend with respect to the height direction of the container body. Unfortunately, if the support shaft is simply tilted, the tilting thereof will be restricted due to its positional relationship with the opening of the container body, and thus, the application section cannot scrape off the cosmetic from the entire container. Further, in the aforementioned Literature, it is difficult to make the application section reach the upper corner (shoulder section) of the container body due to the positional relationship with a squeezing member, which is for squeezing the application section and which is provided near the opening, as viewed from the vertical cross-sectional direction. Thus, it is difficult to scrape off the cosmetic from the entire region of the interior of the container body.

SUMMARY OF INVENTION

The present invention provides a cosmetic application device including a cosmetic application tool for applying a cosmetic and a container for containing the cosmetic, wherein the application tool is insertable into and removable from the container through an opening of the container.

The container includes: a substantially tubular containing section that has a bottom and that is for containing the cosmetic; and a substantially cylindrical mouth/neck section that is provided contiguously to the containing section and that has a smaller lateral cross-sectional area than the containing section.

The application tool includes: an application section for applying the cosmetic; a support shaft having a front end to which the application section is connected; and a lid body that is connected to a rear end of the support shaft and that is fixable to the mouth/neck section of the container in a state so as to cover the mouth/neck section.

In a state where the lid body is fixed to the mouth/neck section, a lower end section of the lid body is located at an upper end of the containing section.

The mouth/neck section includes: a lower tier section located on the containing section side; and an upper tier section located on the opening side. The mouth/neck section also includes a stepped section that is provided between the mouth/neck section's lower tier section and the mouth/neck section's upper tier section and that has the maximum outer diameter in the mouth/neck section.

In a state where the lid body is fixed to the mouth/neck section, a first clearance is formed between an upper end of the mouth/neck section's upper tier section and an upper-end inner wall of the lid body, and a second clearance is formed between a lower end of the mouth/neck section's lower tier section and a lower-end inner wall of the lid body.

In the mouth/neck section's lower tier section, a section close to the containing section has a narrowed shape, and the mouth/neck section's lower tier section has a lateral cross-sectional area that gradually decreases from an upper section thereof toward the containing section.

When the application tool is tilted in a state where the fixation between the lid body and the mouth/neck section has been released and the lower end section of the lid body is located at a position within the height-wise length of the mouth/neck section, the application section of the application tool is made to contact an inner wall in the vicinity of the bottom section of the containing section of the container.

The present invention also provides a lip cosmetic including a composition that has a penetration hardness of from 0.5 N to 100 N, inclusive, at 30° C. as measured with a 5-mm-dia. penetrator, the composition being filled into the aforementioned cosmetic application device.

BRIEF DESCRIPTION OF DRAWINGS

FIGS. 8(*a*) to 8(*c*) are front views illustrating other embodiments of the container of the cosmetic application device of the present invention.

DESCRIPTION OF EMBODIMENTS

Figure 1:
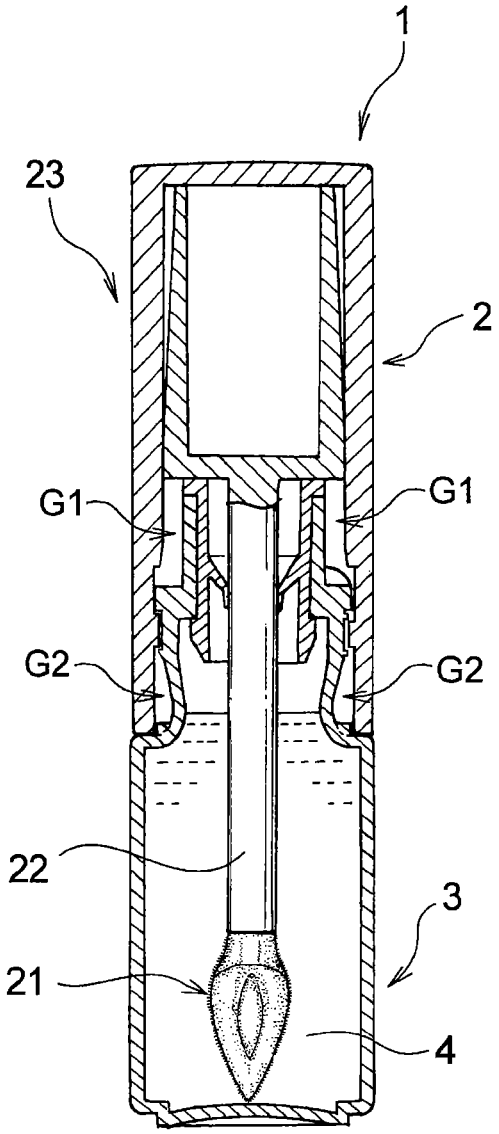
FIG. 1 is a cross-sectional view, as viewed from the front, of an embodiment of a cosmetic application device of the present invention.

The cosmetic application device of the present invention will be described below according to preferred embodiments thereof with reference to the drawings. It should be noted that the cosmetic application devices according to the illustrated embodiments merely describe examples of preferred embodiments of the present invention, and the present invention is not to be limited to those embodiments. FIG. 1 illustrates a cross-sectional view, as viewed from the front, of an embodiment of a cosmetic application device of the present invention. This figure illustrates a state of the cosmetic application device before use.

The cosmetic application device 1 of the present embodiment as illustrated in the figure includes: an application tool 2 for applying a cosmetic 4; and a container 3 for containing the cosmetic 4. The application tool 2 and the container 3 will be described below.

Figure 2:
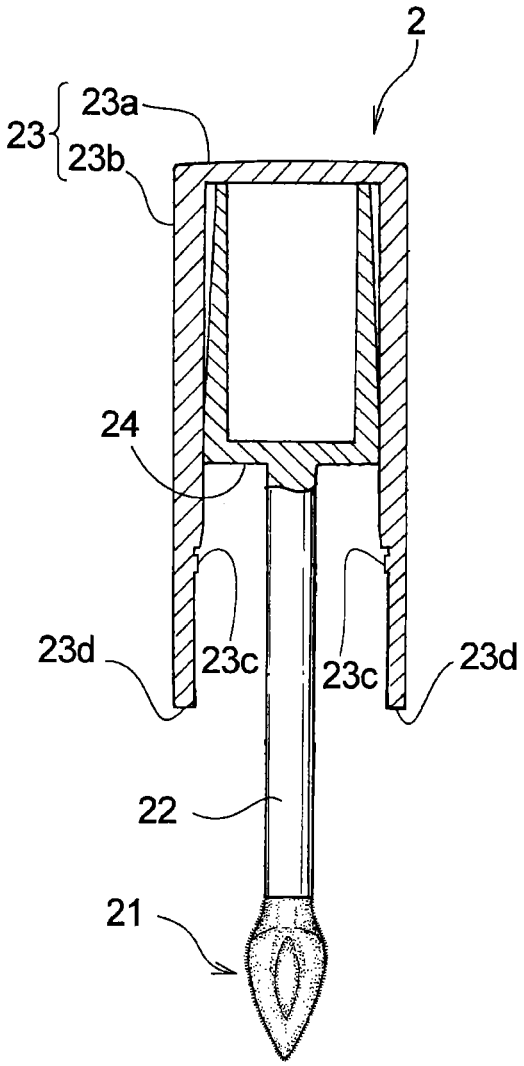
FIG. 2 is a partially exploded front view of a cosmetic application tool of the cosmetic application device illustrated in FIG. 1.

First, the application tool 2 will be described. As illustrated in FIG. 2, the application tool 2 includes an application section 21 and a support shaft 22. These members are insertable into and removable from the container 3 through an opening 33 in the container 3. The application section 21 is used for applying the cosmetic 4 to a section to which the cosmetic is to be applied. The support shaft 22 is connected, at its front end, to the application section 21. The application section 21 and the support shaft 22 may be made integrally from the same material, or two separate members manufactured in advance may be joined by a predetermined means. In cases of separately manufacturing the application section 21 and the support shaft 22 and joining them together, it is preferable to join the two by fitting them together. An example of a joining method is a method of plastically deforming the application section 21 or the support shaft 22 by punching, and fixing the two together. Alternatively, known techniques, such as bonding with an adhesive, may be employed as appropriate.

The support shaft 22 is preferably made of a material that is flexible but is resistant to deformation by external force. If the support shaft 22 is prone to deform by external force, then the support shaft 22 is likely to bend when the application section 21 is placed in contact with an object-for-application at the time of applying the cosmetic, which may make it difficult to apply the cosmetic. A preferred example of a material that is resistant to deformation by external force includes a material having a flexural modulus of from 0.5 GPa to 5 GPa, inclusive, as measured according to JIS K 7171. Concrete examples of materials having such physical properties include: polyesters, such as polybutylene terephthalate, polyethylene terephthalate, and polytrimethylene glycol terephthalate; polypropylene; nylons, such as nylon 6, nylon 66, nylon 610, and nylon 612; and polyacetal resins; wherein polybutylene terephthalate, polypropylene, nylons, polyacetal resins are more preferable. It is preferable that the support shaft 22 is made of one type of the aforementioned materials, or a mixture of two or more types thereof, along its entire length. It is also preferable that parts along the length direction of the support shaft do not include sections made of a material that is elastically deformed easily, because, at the time of scraping off the cosmetic 4 remaining in the corners of the container 3, the support shaft 22 will get bent only in those sections and the transmission of force will become difficult.

The application tool 2 also includes a lid body 23. The lid body 23 includes a top surface 23*a*, and a lid trunk wall section 23*b* that hangs down from the peripheral edge of the top surface 23*a*. The interior of the lid body 23 constitutes a hollow cavity, and a fitting member 24 is fitted in the cavity. The fitting member 24 is connected to the rear end of the support shaft 22. Thus, the lid body 23 is connected to the rear end of the support shaft 22 via the fitting member 24. It should be noted that the fitting member 24 and the support shaft 22 may be formed integrally, or may be fixed together by various means, such as bonding or fitting. The lid body 23 is fixable to a later-described mouth/neck section 32 of the container 3.

Protrusions 23*c* are formed on the inner surface of the lid trunk wall section 23*b*. The position of each protrusion 23*c*, in the height direction of the lid body 23, is below the section where the fitting member 24 and the support shaft 22 are connected and above the lower end 23*d* of the lid trunk wall section 23*b*. The protrusions 23*c* are provided at two points. More specifically, in a lateral cross-sectional view of the lid body 23, two protrusions 23*c* are arranged so as to be in a positional relationship in which they are separated by 180 degrees, for example. The protrusions 23*c* engage with later-described lock mechanisms 35 provided to the container 3, and are used for fixing the lid body 23 and the container 3 together. As illustrated in FIG. 1, in a state where the lid body 23 and the container 3 are fixed, the lid body 23 is fixed to the mouth/neck section 32 of the container 3 so as to cover the mouth/neck section 32. In this state, the lower end section 23*d* of the lid body 23 is located at the upper end of the containing section 31 of the container 3—i.e., on the upper surface of a later-described first stepped section 34*a*—and the outer surface of the lid body 23 is smoothly continuous with the outer surface of the container 3. Thus, the overall shape of the application device 1 is substantially cylindrically-columnar. In this state, the front end of the application section 21 is located slightly above the bottom section of the container 3. It should be noted that the overall shape of the application device 1 is not limited to a substantially cylindrically-columnar shape, but may have other shapes, such as a substantially prismatic shape.

Figure 3A:
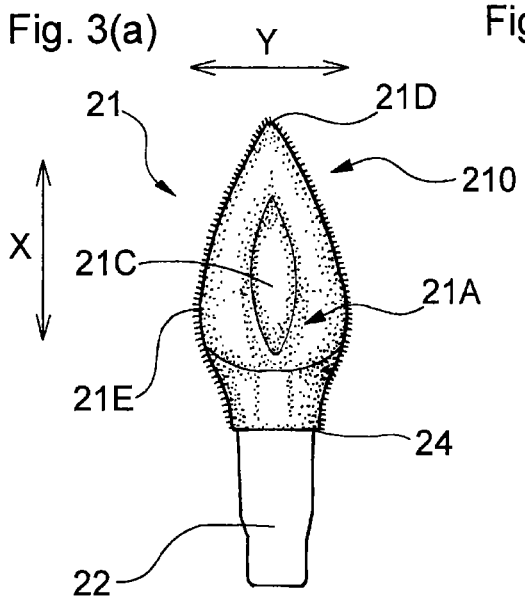
FIG. 3(*a*) is a front view of an application section of the cosmetic application device illustrated in FIG. 1, and FIG. 3(*b*) is a side view of the application section of the cosmetic application device illustrated in FIG. 1.
Figure 3B:
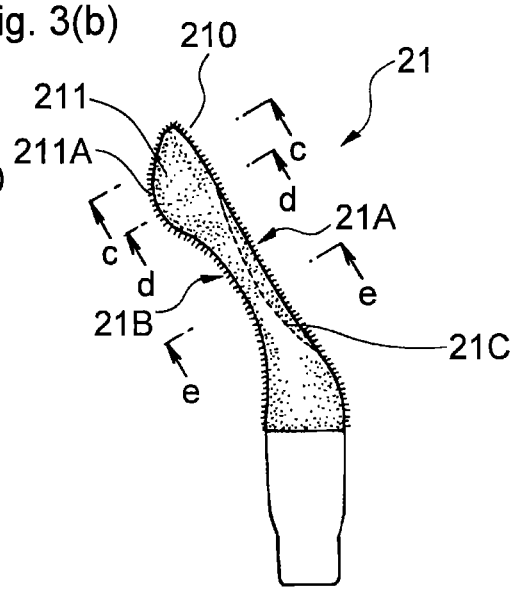
Figure 4A:
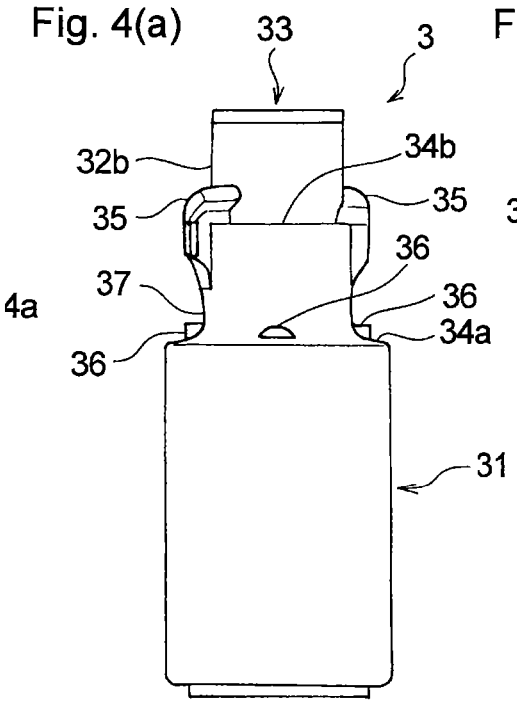
FIG. 4(*a*) is a front view of a container of the cosmetic application device illustrated in FIG. 1, FIG. 4(*b*) is a side view of the container of the cosmetic application device illustrated in FIG. 1, FIG. 4(*c*) is a vertical cross-sectional view of FIG. 4(*a*), and FIG. 4(*d*) is a vertical cross-sectional view of FIG. 4(*b*).
Figure 4B:
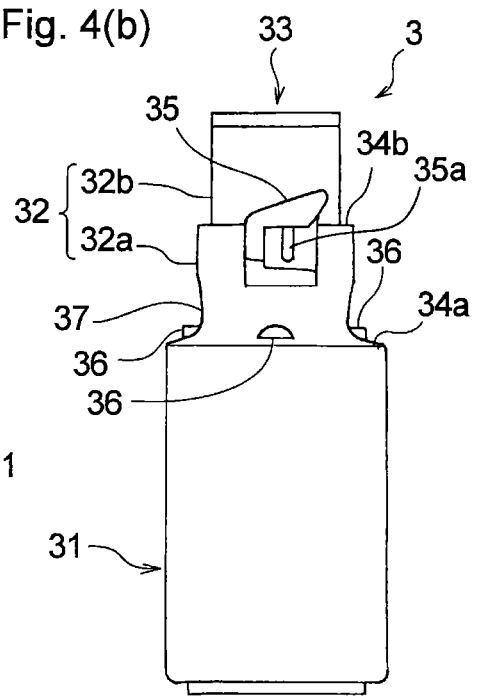
Figure 4C:
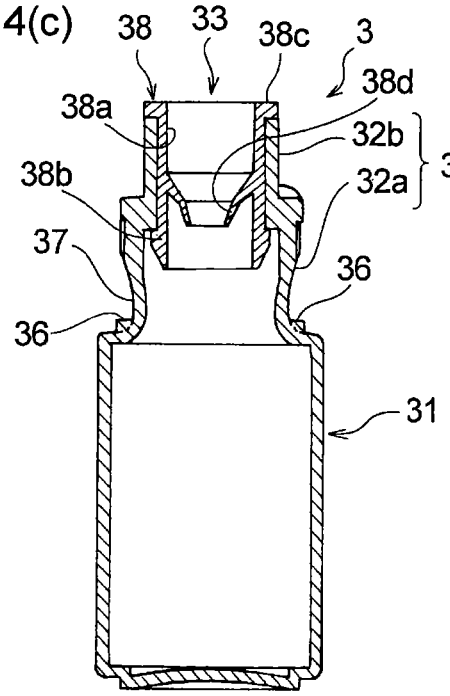
Figure 4D:
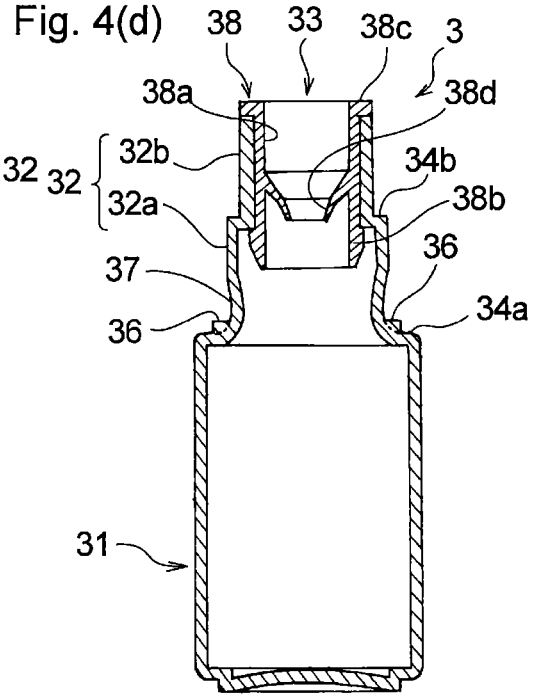

FIG. 3 shows enlarged figures of the main parts of the application section 21. The application section 21 is a flat body that is wider than the support shaft 22. The application section 21 has a vertically long shape having a length direction X in the direction in which the support shaft extends, and a width direction Y in the direction orthogonal to the length direction X. The application section 21 has a first surface 21A which is an application surface, and a second surface 21B located on the opposite side from the first surface. The first surface 21A constitutes a concave surface in relation to the width direction Y of the application section 21. On the other hand, the second surface 21B constitutes a flat surface or a slightly convex surface.

The application section 21 has a recessed section 21C in the central section of the first surface 21A which is a concave surface. The recessed section 21C is the section that mainly holds the cosmetic 4 in the first surface 21A. The recessed section 21C extends in the length direction of the application section 21. The thickness of the application section 21 in the recessed section 21C is smaller than the thickness in the peripheral edge of the recessed section 21C.

The application section 21 is sloped by a predetermined angle with respect to the support shaft 22. More specifically, as illustrated in FIG. 1, the application section 21 is sloped with respect to the axial direction of the support shaft 22 in such a manner that the first surface 21A, which is the concave surface of the application section 21, faces toward the direction of the bottom section of the container 3 in a state where the application tool 2 is inserted in the container 3. By joining the application section 21 and the support shaft 22 in this sloped relationship, cosmetics remaining in the vicinity of the bottom section of the container 3 and in the upper corners can be scraped off successfully. Further, the cosmetic 4 can be applied easily by using the application tool 2.

The surface of the application section 21 may be subjected to a flocking treatment. It is preferable that the fibers used for flocking have a length ranging from 0.1 to 3 mm and a thickness ranging from 0.5 to 5 dtex. It is also possible to use, in combination, two or more different types of fibers within the aforementioned length and thickness range. The properties of the material of the fibers are chosen as appropriate depending on the feel that is required at the time of application. In general, the use of polyamide resins provides a preferable soft feel. Known techniques, such as electrostatic flocking, may be employed as appropriate in order to subject the surface of the application section to the flocking treatment.

The application section 21 has a widest section 21E as viewed from the front (i.e., in a cross-sectional view in the width direction Y). It is preferable that the widest section exists at a single point, but it may exist at two or more points, and it may exist over a certain length. The width of the application section 21 gradually narrows from the widest section 21E toward the connecting section 24 with the support shaft 22. Here, "width" refers to the length in the Y direction in FIG. 3(*a*). At the connecting section 24, the width of the application section 21 and the width (i.e., the diameter) of the support shaft 22 are substantially the same. The widest section 21E is located at a point separated from the front end 21D of the application section 21. The width of the application section 21 gradually narrows from the widest section 21E toward the front end 21D. It is preferable that the front end 21D is made substantially acute. An acute front end 21D makes detailed application possible. For example, the cosmetic can be applied easily to the corners of the mouth. As described above, the width of the application section 21 gradually widens from the front end 21D to the widest section 21E, and then gradually narrows from the widest section 21E to the connecting section 24.

The front end region 210 of the application section 21 has a greater thickness than the widest section 21E. More specifically, the front end region 210 is made thick by having a protruding section 211 that is protruded on the second surface 21B side, which is the opposite side from the first surface 21A which is the application surface. It should be noted that, here, "thickness" refers to the length of the application section 21 within a plane that includes the length direction of the application section 21 and that is orthogonal to the first surface 21A which is the application surface of the application section 21.

The front end region 210 having the protruding section 211 has a thickness that gradually increases from the front end 21D of the application section 21 toward the rear end thereof and has a maximum thickness section 211A, and the thickness of the front end region 210 gradually decreases from the maximum thickness section 211A toward the rear end and approaches the thickness of the widest section 21E. By providing the protruding section 211 with the aforementioned three-dimensional shape, cosmetics remaining in the vicinity of the bottom section of the container 3 and in the upper corners can be scraped off successfully. Further, the application section 21 can be easily inserted into and removed from the containing section 31 of the container 3. Further, when the vicinity of the front end region 210 of the application section 21 (i.e., the section of the application section with a small lateral cross-sectional area) passes through the opening in the later-described squeezing valve 38*d* at the time of removing the application section 21 from the container 3, the gap between the front end region 210 of the application section 21 and the squeezing valve's opening can be made small, and thus, the cosmetic adhering to the periphery of the front end region 210 can be squeezed off effectively, and as a result, it is possible to prevent the cosmetic from adhering excessively to the front end region 210 and dripping, and prevent the cosmetic from spreading out of bounds at the time of application.

Next, the container 3 will be described. As illustrated in FIGS. 4(*a*) to 4(*d*), the container 3 is made so as to be able to contain a cosmetic therein. Depending on the specific use of the cosmetic application device 1 and the specific type of cosmetic 4, the container 3 may be made transparent to an extent that the cosmetic 4 is visible from the outside, or may be made opaque to an extent that the cosmetic is not visible. The container 3 includes a substantially tubular containing section 31 that has a bottom and that is for containing the cosmetic. The container 3 also includes a substantially cylindrical mouth/neck section 32 that is provided contiguously to the containing section 31. The mouth/neck section 32 has, in its upper end, an opening 33 that is opened upward.

It is preferable that the space inside the containing section 31 of the container 3 is substantially cylindrically-columnar. In contrast, the shape of the outer surface of the containing section 31 is not particularly limited, and it may have a different shape, such as a cylindrically-columnar or prismatic shape.

The mouth/neck section 32 of the container 3 has a smaller lateral cross-sectional area than the lateral cross-sectional area of the containing section 31. Here, "lateral cross-sectional area" is a value calculated on the basis of the outer diameter in case of both the containing section 31 and the mouth/neck section 32. If the container 3 is viewed from its height direction, the central position of the mouth/neck section 32 in its lateral cross section substantially matches the central position of the containing section 31 in its lateral cross section. Thus, in this container 3, a stepped section 34*a* is formed at the section where the containing section 31 is made contiguous to the mouth/neck section 32. Hereinbelow, this stepped section is referred to as the first stepped section 34*a*. The cosmetic 4 is filled into and contained in the containing section 31.

The mouth/neck section 32 also includes a lower tier section 32*a* located on the containing section 31 side, and an upper tier section 32*b* located on the opening 33 side. The mouth/neck section's lower tier section 32*a* is provided contiguously to the containing section 31. The mouth/neck section's upper tier section 32*b* is provided contiguously to the upper end of the mouth/neck section's lower tier section 32*a*, and has a smaller lateral cross-sectional area than the mouth/neck section's lower tier section 32*a*. Here, "lateral cross-sectional area" is a value calculated on the basis of the outer diameter in case of both the mouth/neck section's lower tier section 32*a* and the mouth/neck section's upper tier section 32*b*. The mouth/neck section 32 has a two-tiered structure, and a stepped section 34*b* is formed at the section where the mouth/neck section's lower tier section 32*a* is made contiguous to the upper tier section 32*b*. Hereinafter, this stepped section is referred to as the second stepped section 34*b*. The second stepped section 34*b* is located in a substantially central region of the mouth/neck section 32 in the height direction thereof. The second stepped section 34*b* is the section having the maximum diameter in the mouth/neck section 32. It is preferable that the second stepped section 34*b* is located at a position that is preferably above or equal to 40%, and more preferably above or equal to 45%, from the lower end of the mouth/neck section 32 with respect to the height of the mouth/neck section 32. Further, it is preferable that the second stepped section 34*b* is located at a position that is preferably below or equal to 60%, and more preferably below or equal to 55%, from the lower end of the mouth/neck section 32 with respect to the height of the mouth/neck section 32. For example, the second stepped section 34*b* is located at a position that is preferably from 40% to 60% inclusive, and more preferably from 45% to 55% inclusive, from the lower end of the mouth/neck section 32 with respect to the height of the mouth/neck section 32.

An engagement section for engaging and fixing the mouth/neck section 32 and the aforementioned lid body 23 is provided to the second stepped section 34*b*. The engagement section is constituted by lock mechanisms 35 each constituted by an engagement pawl. In a state where the lid body 23 is fixed to the mouth/neck section 32, each protrusion 23*c* (cf. FIG. 2) formed on the inner wall of the lid trunk wall section 23*b* of the lid body 23 engages with the engagement pawl 35*a* (cf. FIG. 4(*b*)) of the lock mechanism 35. The lock mechanisms 35 are provided at two points. More specifically, two lock mechanisms 35 are arranged so as to be in a positional relationship in which they are separated by 180 degrees in a lateral cross-sectional view of the mouth/neck section 32. The two lock mechanisms 35 are arranged at the same position in the height direction of the mouth/neck section 32. It should be noted that the number of lock mechanisms 35 to be arranged is not limited to two, and there may be three or more lock mechanisms. Regardless of the number of lock mechanisms 35 to be arranged, it is preferable that the plurality of lock mechanisms 35 are arranged at the same position in the height direction of the mouth/neck section 32 and intermittently at even intervals along the circumferential direction of the mouth/neck section 32, from the viewpoint of facilitating the fixation between the mouth/neck section 32 and the lid body 23. It is not necessary to form the lock mechanism 35 continuously along the entire perimeter of the mouth/neck section 32.

At the time of engaging and fixing the lid body 23 to the mouth/neck section 32 with the lock mechanisms 35 and at the time of disengaging the engaged/fixed state, it is only necessary to rotate the lid body 23 within a horizontal plane. During the rotation of the lid body 23, there is no substantial change in the height-wise position of the lid body 23. Here, "substantial" means that a momentary change in the height-wise position of the lid body 23 is permitted when the lid body 23 is rotated and the protrusions 23*c* (cf. FIG. 2) formed on the lid trunk wall section 23*b* of the lid body 23 move over the engagement pawls 35*a* of the respective lock mechanisms 35. The height-wise position of the lid body 23 after releasing the fixed state is substantially the same as the height-wise position of the lid body 23 in the fixed state. In contrast, in cases where the lid body 23 is fixed to the mouth/neck section 32 by e.g. screwing, the height-wise position of the lid body changes along with the rotation of the lid body 23. The angle of rotation of the lid body 23 necessary to release the engaged/fixed state by using the lock mechanisms 35 is preferably 60 degrees or less, more preferably 45 degrees or less, and preferably 25 degrees or greater.

The first stepped section 34*a* is provided with small protruding sections 36 adjacent to the mouth/neck section's lower tier section 32*a* of the mouth/neck section 32. The small protruding sections 36 are intermittently provided at four points along the circumferential direction of the mouth/neck section's lower tier section 32*a*. In a lateral cross-sectional view of the mouth/neck section's lower tier section 32*a*, the adjacent small protruding sections 36 are arranged so as to be in a positional relationship in which they are separated by 90 degrees. The small protruding sections 36 are provided in order to prevent the occurrence of backlash caused by a gap being formed between the lower end section 23*d* (cf. FIG. 2) of the lid trunk wall section 23*b* of the lid body 23 and the outer peripheral surface of the mouth/neck section's lower tier section 32*a* in a state where the mouth/neck section 32 and the lid body 23 are engaged. The number of small protruding sections 36 is not limited to four, so long as the occurrence of backlash can be prevented. For example, two small protruding sections 36 may be arranged so as to be in a positional relationship in which they are separated by 180 degrees in a lateral cross-sectional view of the mouth/neck section's lower tier section 32*a*. From the viewpoint of preventing backlash, it is advantageous to increase the number of small protruding sections 36, but if the number of small protruding sections 36 is increased, the lower end section 23*d* of the lid trunk wall section 23*b* of the lid body 23 is more likely to abut against the outer surface of the mouth/neck section 32 when the cosmetic application tool 2 is tilted, which will make it difficult to increase the tilting angle of the application tool 2, as will be described later on. Thus, it is preferable to set the number of small protruding sections 36 as described above.

The mouth/neck section 32 has a narrowed section 37 at a position, in the height direction thereof, close to the section contiguous to the containing section 31, and thus has a narrowed shape. The narrowed section 37 is formed in the mouth/neck section's lower tier section 32*a* which has a stepped structure. In other words, in the mouth/neck section's lower tier section 32*a*, a section close to the containing section 31 has a narrowed shape. The narrowed section 37 is formed along the entire circumference-wise region of the mouth/neck section's lower tier section 32*a*. Thus, in a state where the lid body 23 is engaged and fixed to the mouth/neck section 32, a clearance G2 (cf. FIG. 1) is formed between the lower end of the mouth/neck section's lower tier section 32*a* and the lower-end inner wall of the lid trunk wall section 23*b* of the lid body 23 along the entire perimeter at the position of the narrowed section 37. In addition, a clearance G1 (cf. FIG. 1) is also formed between the upper end of the mouth/neck section's upper tier section 32*b* and the upper-end inner wall of the lid trunk wall section 23*b* of the lid body 23. The lateral cross-sectional area of the mouth/neck section's lower tier section 32*a* is greatest at the section contiguous to the mouth/neck section's upper tier section 32*b*, and the lateral cross-sectional area of the mouth/neck section's lower tier section 32*a* gradually decreases toward the narrowed section 37, which is provided below the contiguous section. In other words, the mouth/neck section's lower tier section 32*a* has a lateral cross-sectional area that gradually decreases from the upper section thereof toward the containing section 31. Thus, the mouth/neck section's lower tier section 32*a* does not have a section bulging outward (i.e., a section protruding outward) in a vertical cross-sectional view thereof.

Preferably, the narrowed section 37 extends toward the lower section thereof and is connected with the first stepped section 34*a* by a continuous, smooth curved surface. Thus, when the support shaft 22 is tilted, the front end of the application section 21 can easily contact the inner wall of the containing section 31 of the container 3. It is preferable that, in the narrowed section 37, the lateral cross-sectional area gradually decreases from the upper section toward the lower section thereof and the lateral cross-sectional area becomes the smallest near the first stepped section 34*a* of the mouth/neck section 32, because, in this way, the support shaft 22 can be tilted to a great extent without making the lower end 23*d* of the lid trunk wall section 23*b* contact the mouth/neck section 32 (narrowed section 37) at the time of tilting the support shaft.

A squeezing member 38 is attached to the mouth/neck section 32. The squeezing member 38 is attached so as to fit with the inner surface of the mouth/neck section's upper tier section 32*b*. The squeezing member 38 has a tubular support member 38*a*. The support member 38*a* has a protrusion 38*b* on the outer surface of the lower section thereof. The squeezing member's protrusion 38*b* engages with the stepped section in the inner wall corresponding to the second stepped section 34*b* of the mouth/neck section 32, and thereby prevents the squeezing member 38 from falling out from the mouth/neck section 32. Alternatively, the squeezing member's protrusion 38*b* does not have to be provided, so long as a sufficient strength for preventing the squeezing member 38 from falling out from the mouth/neck section's upper tier section 32*b* can be obtained by bonding the outer surface of the support member 38*a* and the inner wall of the mouth/neck section 32 together, or by fitting the support member 38*a* into the mouth/neck section 32. Further, the support member 38*a* has a flange section 38*c* at the upper end section thereof. The diameter of the flange section 38*c* is greater than the diameter of the opening 33, and the flange section 38*c* is positioned on the upper end surface of the peripheral edge of the opening 33. Thus, the flange section 38*c* restricts the squeezing member 38 from falling out downward from the mouth/neck section 32.

The squeezing member 38 further includes a squeezing valve 38*d* that extends downward in a conical shape from the inner wall of the support member 38*a*. The squeezing valve 38*d* is shaped like a funnel that is reduced in diameter toward the downward direction, and, at the position of its lower end, the squeezing valve has an opening through which the application section 21 of the application tool 2 is made insertable and removable. The squeezing valve 38*d* is employed to moderately squeeze out excessive amounts of the cosmetic 4 adhering to the application section 21 and/or the support shaft 22 of the application tool 2. For this purpose, it is advantageous to form the squeezing member 38, including the squeezing valve 38*d*, out of an elastically deformable material, such as rubber.

It is preferable that the squeezing valve 38*d* is arranged such that the tip end section of the squeezing valve 38*d* is located near the height-wise center of the mouth/neck section 32 when the squeezing member 38 is attached to the mouth/neck section 32. It is particularly preferable that the squeezing valve 38*d* is located at substantially the same position as the aforementioned second stepped section 34*b* in the height direction of the container 3. By arranging the squeezing member 38 in this way, the distance that the lower end section 23*d* of the lid body 23 moves toward to the mouth/neck section 32 becomes substantially equal to the distance that the inner surface of the lid body 23 moves toward to the vicinity of the opening 33 of the mouth/neck section 32 when the cosmetic application tool 2 is tilted, and thus, the cosmetic application tool 2 can be tilted to the greatest extent by effectively employing the dimensions of the cosmetic application device that are limited by design.

Figure 5:
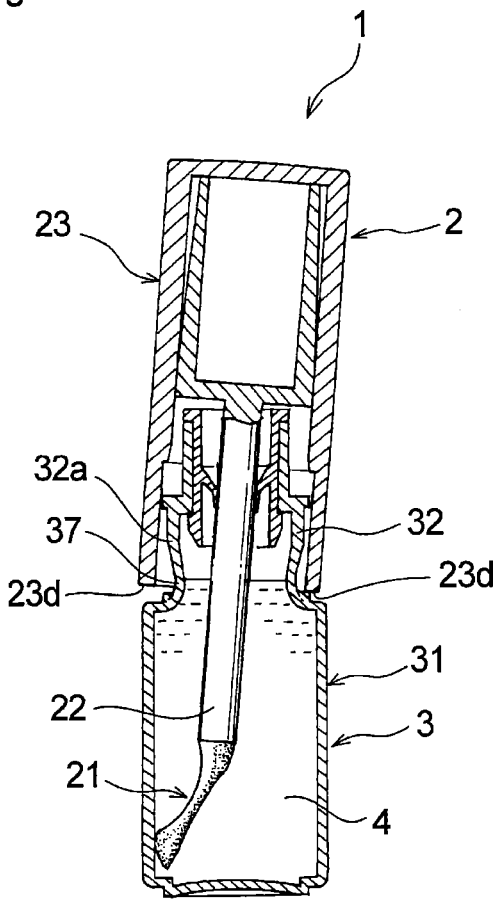
FIG. 5 is a cross-sectional view, as viewed from the side, of an example of a state of use of the cosmetic application device illustrated in FIG. 1.

FIG. 5 illustrates a state in which the engagement/fixation between the lid body 23 and the mouth/neck section 32 in the cosmetic application device 1 in the state as illustrated in FIG. 1 has been released and the cosmetic application tool 2 including the lid body 23 is tilted with respect to the vertical line. In this state, a portion of the lower end section 23*d* of the lid body 23 is located at a position within the height-wise length of the mouth/neck section 32. As described above, the lock mechanism 35, which is employed in the present embodiment for engaging/fixing the lid body 23 and the mouth/neck section 32, is made in such a manner that the height-wise position of the lid body 23 is substantially at the same position (i.e., hardly changes) at the time of engagement/fixation and disengagement between the two. Thus, the position of the front end of the application section 21, which is connected to the lid body 23, is substantially at the same position (i.e., hardly changes) when the engagement/fixation is released. Thanks thereto, when the cosmetic application tool 2 is tilted, the application section 21 can be made to easily contact the inner wall in the vicinity of the bottom section of the containing section 31 of the container 3. For example, the front end of the application section 21, or a section in the vicinity of the front end, can be made to easily contact the inner wall in the vicinity of the bottom section of the containing section 31 of the container 3. Here, "inner wall in the vicinity of the bottom section of the containing section 31" refers to the inner wall located at a position that is within 25% from the bottom section with respect to the height of the containing section 31.

Further, in order to make the front end of the application section 21 contact the inner wall in the vicinity of the bottom section of the containing section 31 of the container 3, it is advantageous to tilt the cosmetic application tool 2 to a great extent with respect to the vertical line. Unfortunately, in usual cases, if the cosmetic application tool is tilted in the container, the lower end section of the lid body will contact the outer peripheral surface of the mouth/neck section, or the inner wall section of the lid body will contact the upper-end outer wall section of the mouth/neck section, before the front end of the application section contacts the inner wall of the containing section 31, and thus, further tilting will be restricted. In contrast, in the present embodiment, a narrowed section 37 is formed along the entire circumference-wise region in the outer peripheral surface of the lower tier section 32a of the mouth/neck section 32, and the clearance G2 (cf. FIG. 1) is formed. Thus, the lower end section 23*d* of the lid body 23 is less likely to abut against the outer peripheral surface of the mouth/neck section 32, and it is possible to tilt the cosmetic application tool 2 to a greater extent with respect to the vertical line compared to conventional art. In other words, when the cosmetic application tool 2 is tilted, the lower end section 23*d* of the lid body 23 does not contact the outer peripheral surface of the mouth/neck section 32, and the front end of the application section 21 of the cosmetic application tool 2 is made so as to contact the inner wall in the vicinity of the bottom section of the containing section 31. Furthermore, the mouth/neck section 32 has a two-tiered structure and the outer perimeter of the opening 33 of the container 3 is made smaller than the inner peripheral surface of the lid body 23; thus, the inner wall section of the lid body 23 is less likely to contact the upper-end outer wall section of the mouth/neck section 32, and it is possible to tilt the cosmetic application tool 2 to a great extent with respect to the vertical line. This also allows the front end of the application section 21 to easily contact the inner wall in the vicinity of the bottom section of the containing section 31 of the container 3. In addition, the clearance G1 (cf. FIG. 1) is also formed between the upper end of the mouth/neck section's upper tier section 32*b* and the upper-end inner wall of the lid trunk wall section 23*b* of the lid body 23. This also allows the cosmetic application tool 2 to be tilted to a great extent.

The direction in which the lid body 23 is tilted is not particularly limited; the lid body 23 may be tilted in any direction in the entire 360-degree perimeter, and the front end of the application section 21 of the cosmetic application tool 2 can be made to easily contact the entire perimeter of the inner wall in the vicinity of the bottom section of the container 3.

As described above, in this cosmetic application tool 2, the application section 21 is sloped with respect to the support shaft 22, and thus, the application section 21 is tilted to an angle that is greater than or equal to the tilting angle of the cosmetic application tool 2. This also allows the front end of the application section 21 to easily contact the inner wall in the vicinity of the bottom section of the containing section 31 of the container 3. Further, the application section 21 is provided with the maximum thickness section 211A, and thus, the application section 21 can easily contact the inner wall in the vicinity of the bottom section of the containing section 31 of the container 3.

In addition, unlike the techniques described in Patent Literature 1 and 2, the present embodiment includes no section in the mouth/neck section 32 of the container 3 that becomes a resistance at the time of pulling out the cosmetic application tool 2 from the container 3. Thus, the application tool 2 can be pulled out while maintaining the contact between the front end of the application section 21 and the inner wall of the containing section 31 in the state that the cosmetic application tool 2 is titled. As a result, the cosmetic adhering to the inner wall of the containing section 31 can be scraped off easily over the entire height-wise region of the containing section 31, and the remaining amount of cosmetic can be reduced.

Figure 6:
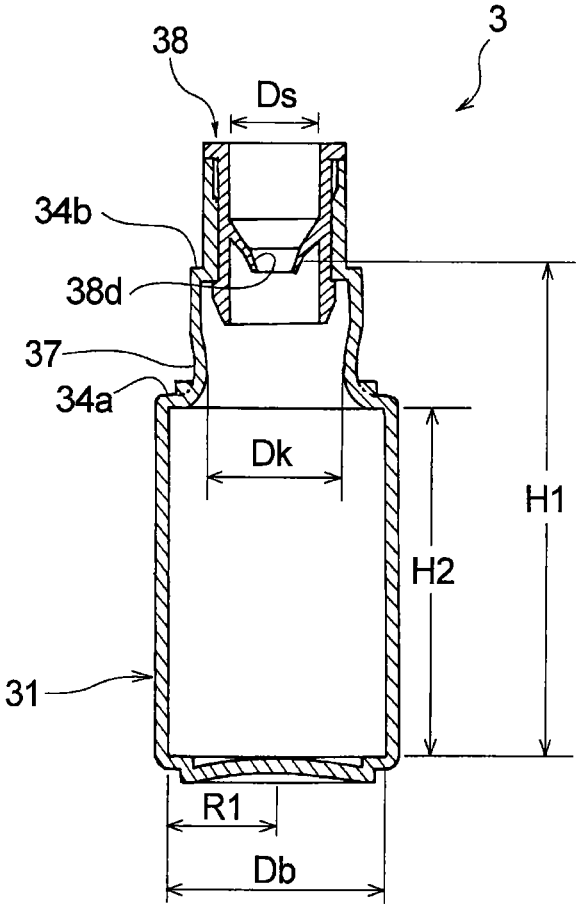
FIG. 6 is a vertical cross-sectional view illustrating the structure of the container of the cosmetic application device illustrated in FIG. 1.

From the viewpoint of making the aforementioned advantage more significant, in this container 3, if the height from the inner surface of the bottom section of the containing section 31 to the squeezing valve 38*d* is defined as H1 and the radius of the containing section 31 is defined as R1 as illustrated in FIG. 6, then the value H1/R1 is preferably 1 or greater, and more preferably 2 or greater. Further, the value H1/R1 is preferably 6 or less, and more preferably 5 or less. For example, the value H1/R1 is preferably from 1 to 6 inclusive, and more preferably from 2 to 5 inclusive. It should be noted that "the height from the inner surface of the bottom section of the containing section 31 to the squeezing valve 38*d*" refers to the distance between the central position at which the squeezing valve 38*d* supports the support shaft (not illustrated in FIG. 6) and the inner surface of the bottom section of the containing section 31.

For the same reason, in this container 3, if the height from the inner surface of the bottom section of the containing section 31 to the upper end of the containing section 31 is defined as H2 as illustrated in FIG. 6, then the value H2/R1 is preferably 1 or greater, and more preferably 1.5 or greater. Further, the value H2/R1 is preferably 4 or less, and more preferably 3.5 or less. For example, the value H2/R1 is preferably from 1 to 4 inclusive, and more preferably from 1.5 to 3.5 inclusive.

From the viewpoint of making the aforementioned advantage more significant, in this container 3, if the inner diameter of the squeezing member 38 is defined as Ds and the minimum inner diameter of the narrowed section 37 is defined as Dk as illustrated in FIG. 6, then the value Dk/Ds is preferably 1 or greater, and more preferably 1.2 or greater. Further, the value Dk/Ds is preferably 3 or less, and more preferably 1.8 or less. For example, the value Dk/Ds is preferably from 1 to 3 inclusive, and more preferably from 1.2 to 1.8 inclusive. By setting the value Dk/Ds within the aforementioned range, the cosmetic adhering to the inner wall in the vicinity of the bottom section of the containing section 31 can be scraped off successfully. In addition, the cosmetic adhering to the inner wall of the shoulder section of the containing section 31 can also be scraped off successfully.

Figure 7:
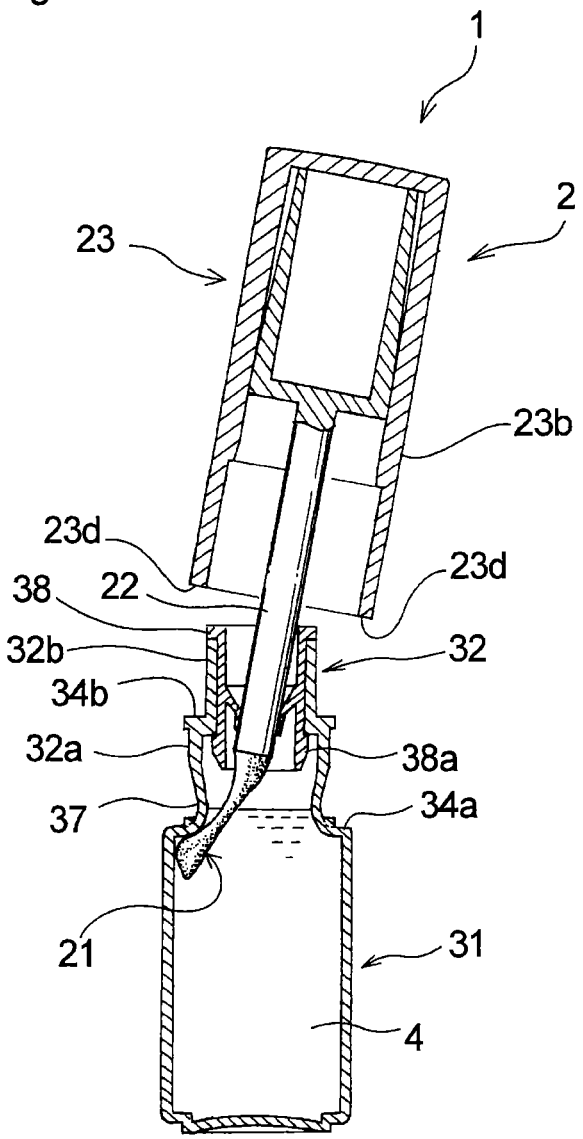
FIG. 7 is a cross-sectional view, as viewed from the side, of another example of a state of use of the cosmetic application device illustrated in FIG. 1.

FIG. 7 illustrates a state in which the engagement/fixation between the lid body 23 and the mouth/neck section 32 in the cosmetic application device 1 in the state as illustrated in FIG. 1 has been released, and the cosmetic application tool 2 including the lid body 23 has been pulled out upward and is tilted with respect to the vertical line. In this state, the entire region of the lower end section 23*d* of the lid body 23 is located at a position beyond the upper end of the mouth/neck section 32. Thus, in this state, the lid body 23 does not abut against the mouth/neck section 32 even if the cosmetic application tool 2 is tilted, and so, the tilting of the application tool 2 is not restricted by the mouth/neck section 32. In other words, this is the state for scraping off the cosmetic 4 adhering to the inner wall of the shoulder section of the containing section 31 of the container 3. As described above, in the present embodiment, as illustrated in FIG. 4, the container 3 includes a first stepped section 34*a* and a second stepped section 34*b* located above the first stepped section, the upper surface of the cosmetic 4 is located at a position that is lower than the first stepped section 34*a*, and the lock mechanisms 35 are provided to the second stepped section 34*b*. Thus, the squeezing member's protrusion 38*b* of the squeezing member 38 can engage with the stepped section in the inner wall corresponding to the second stepped section 34*b* of the mouth/neck section 32, and as a result, the squeezing member's protrusion 38*b* can be arranged so as to oppose the inner wall of the mouth/neck section's lower tier section 32*a*, which has a smaller inner diameter than the containing section 31 of the container 3. In contrast, if there is only one stepped section in the container, the squeezing member's protrusion needs to be engaged with the stepped section between the mouth/neck section and the containing section of the container, which results in that the squeezing member's protrusion is arranged so as to oppose the inner wall of the containing section. The capacity of the region between the protrusion and the inner wall of the mouth/neck section's lower tier section is smaller than the capacity of the region between the protrusion and the inner wall of the containing section; so thus, by providing two stepped sections to the container, the remaining amount of cosmetic caused by the protrusion can be reduced compared to cases where only one stepped section is provided. This capacity can further be reduced by providing the narrowed section 37 to the mouth/neck section 32.

Further, by forming the shape of the container's inner wall at the lower section of the narrowed section 37 as a smooth curved surface that matches the shape of the application section 21, it becomes easier to make the front end of the application section 21 abut against the inner wall of the shoulder section of the containing section 31 (i.e., the inner wall of the first stepped section 34*a*). Further, in cases where the application section 21 has a protruding section 211, the protruding section 211 enters the deeply recessed part in the inner wall of the shoulder section of the containing section 31, and thus, the cosmetic on the inner wall of the shoulder section (i.e., the inner wall of the first stepped section 34*a*) can be scraped off even more successfully.

In contrast, in a conventional application device, generally, the container has only one stepped section (between the container's containing section and the mouth/neck section) and a screw structure or engagement structure is provided in the stepped section, and the protrusion in the lower section of the squeezing member is arranged so as to oppose the inner wall of the trunk part of the container's body (in a cross-sectional view). Because there is a great distance between the inner wall and the protrusion in the lower section of the squeezing member, a large amount of cosmetic remains therein. If the cosmetic application tool is tilted to a larger angle in an attempt to make the front end of the application section abut against the inner wall in the vicinity of the upper end of the container, the support shaft will abut against a portion of the mouth/neck section before the front end of the application section abuts against the inner wall in the vicinity of the upper end of the container, and thus, the cosmetic application tool cannot be tilted any further, and consequently, the front end of the application section cannot abut against the inner wall in the vicinity of the upper end of the container. It may be possible to simply provide two or more stepped sections to the container; nevertheless, there will be regions in the respective stepped sections that cannot be reached by the application section, and thus, there will be a large amount of cosmetic remaining on the inner wall. In contrast, by providing a narrowed section in the mouth/neck section's lower tier section, it is possible to reduce the capacity of the region where the cosmetic cannot be completely removed which is on the inner side of the second stepped section.

Further, by connecting the lower part of the narrowed section and the first stepped section with a smooth curved line, the application section can easily reach the inside of the first stepped section, and the amount of cosmetic remaining in both the stepped sections can be reduced.

From the viewpoint of making the aforementioned advantage more significant, in this container 3, if the inner diameter of the containing section 31 is defined as Db and the minimum inner diameter of the narrowed section 37 is defined as Dk as illustrated in FIG. 6, then the value Db/Dk is preferably 1 or greater, and more preferably 1.4 or greater. Further, the value Db/Dk is preferably 3 or less, and more preferably 2 or less. For example, the value Db/Dk is preferably from 1 to 3 inclusive, and more preferably from 1.4 to 2 inclusive. By setting the value Db/Dk within the aforementioned range, the cosmetic adhering to the inner wall of the shoulder section of the containing section 31 can be scraped off successfully. The cosmetic adhering to the inner wall of the shoulder section of the containing section 31 can also be scraped off successfully by setting the aforementioned value Dk/Ds within the aforementioned range.

In the state illustrated in FIG. 7, the cosmetic application tool 2 needs to be tilted to a greater extent with respect to the vertical line compared to the aforementioned state illustrated in FIG. 5. From this viewpoint, it is extremely advantageous that the application section 21 of the cosmetic application tool 2 is sloped with respect to the support shaft 22, from the viewpoint of making the front end of the application section 21 abut against the inner wall of the shoulder section of the containing section 31.

Further, in the state illustrated in FIG. 7, it is advantageous to construct the mouth/neck section 32 in such a manner that the tilting of the support shaft 22 of the cosmetic application tool 2 is not restricted by the inner structure of the mouth/neck section 32 of the container 3. Here, "the inner structure of the mouth/neck section 32" is a concept encompassing both the structure of the inner surface of the mouth/neck section 32 itself and also the squeezing member 38 attached to the mouth/neck section 32. It should be noted, however, that the squeezing valve 38*d* of the squeezing member 38 is not included in "the inner structure of the mouth/neck section 32". Further tilting of the support shaft 22 is restricted when the support shaft 22, in its tilted state, abuts against the support member 38*a* at two points inside the mouth/neck section 32—more specifically, at the position in the vicinity of the upper end of the support member 38*a* of the squeezing member 38 and at the position in the vicinity of the lower end thereof—before the front end of the application section 21 abuts against the inner wall of the shoulder section of the containing section 31. Thus, it is advantageous to adjust the height-wise length of the mouth/neck section 32 in such a manner that, in the state illustrated in FIG. 7, the support shaft 22 does not abut against the upper end and the lower end inside the mouth/neck section 32 before the front end of the application section 21 abuts against the inner wall of the shoulder section of the containing section 31 in a state where the cosmetic application tool 2 is tilted.

As described above, the container 3 may be made transparent to an extent that the cosmetic 4 is visible from the outside, or may be made opaque to an extent that the cosmetic is not visible. In case of the latter, a transparent section through which the cosmetic 4 contained in the container 3 is visible may be provided to a side surface of the container 3. Particularly, it is preferable to provide a transparent section to a side surface of the container 3 which is not covered by the lid body 23 in a state where the mouth/neck section 32 of the container 3 is closed by the lid body 23. By adopting such a construction, the remaining amount of cosmetic 4 can be viewed easily. Particularly, because the cosmetic application device 1 of the present embodiment can efficiently scrape off the cosmetic 4 adhering to and remaining on the inner surface of the container 3, the remaining amount of cosmetic 4 can be viewed more easily by wiping off the cosmetic 4 adhering to the inner wall surface of the container 3 above the liquid surface of the cosmetic 4. Conversely, in cases where the container 3 contains a cosmetic 4 that has low flowability and that is less prone to run downward by gravity and such a cosmetic 4 is adhering to the inner wall surface of the container 3, it is easy to wipe that section with the application section 21 because the location where the cosmetic is attached can be viewed easily from the outside. The provision of a transparent section to the side surface of the container 3 is also advantageous in terms that, if the user owns a plurality of the cosmetic application devices 1 containing cosmetics of different colors, the color of the cosmetic can be viewed without opening the lid body 23.

From the viewpoint of visibility of the cosmetic 4, it is advantageous to make the entire region of the side surface of the container 3 transparent. On the other hand, from the viewpoint of protecting the cosmetic 4 from light such as visible rays or UV rays, it is advantageous to make the side surface of the container 3 opaque. Considering the above, it is preferable to provide a transparent section and an opaque section to the side surface of the container 3, and allow the cosmetic 4 to be viewed through the transparent section. Particularly, it is preferable that the area of the transparent section occupies less than or equal to half—more preferably 20% or less, and even more preferably 10% or less—of the entire surface area of the side surface of the container 3 not covered by the lid body 23 in a state where the mouth/neck section 32 of the container 3 is closed by the lid body 23. Furthermore, the container 3 can be provided with design aesthetics by providing transparent sections and opaque sections. Moreover, a sense of uniformity can be created within a series of products, and the products can be differentiated from other products.

As for the relationship according to which the transparent sections and opaque sections are arranged, it is possible to employ, for example, an opaque section 50 as a continuous undercoating pattern, and one or more transparent sections 51 surrounded by the opaque section 50, as illustrated in FIGS. 8(*a*) to 8(*c*). The transparent sections 51 may have: (i) an anisotropic shape as illustrated in FIGS. 8(*a*) and 8(*b*); or (ii) an isotropic shape, or a shape with a small degree of anisotropy, as illustrated in FIG. 8(*c*). In the case of (i), it is preferable that, when focusing on one transparent section 51, the transparent section 51 has a shape that extends in the height direction of the container 3 (cf. FIGS. 8(*a*) and 8(*b*)). In FIG. 8(*a*), an oval transparent section 51 extends in the height direction of the container 3. In FIG. 8(*b*), a diamond-shaped transparent section 51 extends in the height direction of the container 3. In the case of (ii), it is preferable that a plurality of transparent sections 51 are arranged intermittently so as to form a row in the height direction of the container 3, as illustrated in FIG. 8(*c*).

Figure 9A:
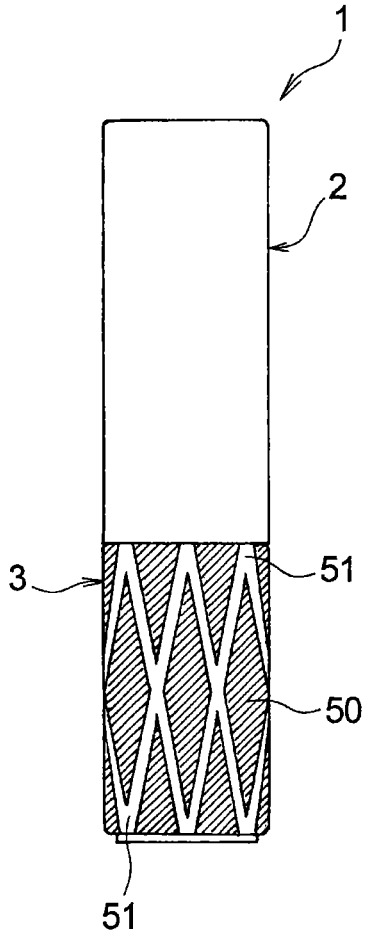
FIGS. 9(*a*) and 9(*b*) are front views illustrating still other embodiments of the container of the cosmetic application device of the present invention.
Figure 9B:
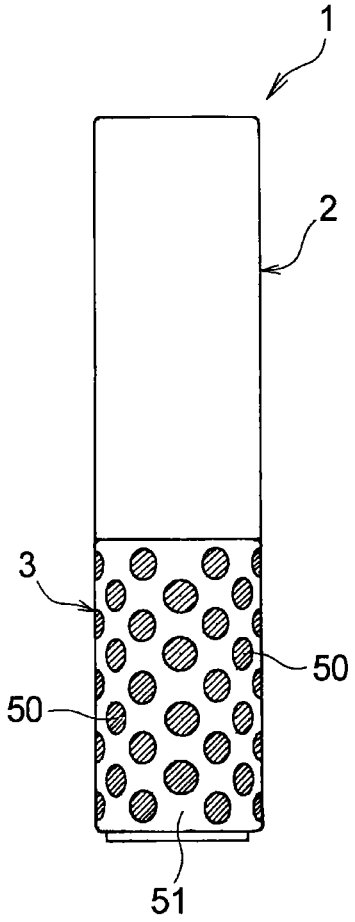

As for the relationship according to which the transparent sections and opaque sections are arranged, opposite from FIGS. 8(*a*) to 8(*c*), it is possible to employ transparent sections 51 as a continuous undercoating pattern, and one or more opaque sections 50 surrounded by the transparent sections 51, as illustrated in FIGS. 9(*a*) and 9(*b*). The opaque sections 50 may have: an anisotropic shape as illustrated in FIG. 9(*a*); or an isotropic shape, or a shape with a small degree of anisotropy, as illustrated in FIG. 9(*b*). In the former case, it is preferable that, when focusing on one opaque section 50, the opaque section 50 has a shape that extends in the height direction of the container 3 (cf. FIG. 9(*a*)). In this figure, diamond-shaped opaque sections 50 extend in the height direction of the container 3. In the latter case, as illustrated in FIG. 9(*b*), it is preferable that a plurality of opaque sections 50 are arranged intermittently so as to form a row in the height direction of the container 3.

The transparent sections and opaque sections may be formed by various methods. For example, the transparent sections and opaque sections may be formed by molding the container 3 by using a transparent resin, and covering the side surface of the container 3 with a shrink film having transparent sections and opaque sections. Alternatively, the transparent sections and opaque sections may be formed by first masking sections on the outer side surface of an overall-transparent container 3 that become the transparent sections, then making the unmasked sections of the outer side surface opaque by painting or vapor deposition, and then removing the masking. As another method, by performing co-injection molding (injection molding) by using a transparent resin and an opaque resin, the transparent sections and opaque sections may be formed simply by molding.

As for the cosmetic to be contained in the cosmetic application device of the present embodiment, it is possible to use a liquid or semi-solid cosmetic having flowability in the usage environment, and more preferably a cosmetic having consistency. Examples of forms of cosmetics include lip cosmetics, such as various lipsticks, lip gloss, and lip colors, and eye cosmetics such as mascara. For example, as for a lip cosmetic, it is preferable to use a semi-solid composition that has a penetration hardness of from 0.5 N to 100 N, inclusive, at 30° C. as measured with a 5-mm-dia. penetrator. Herein, "penetration hardness" is the maximum value for when a 5-mm-dia. penetrator is penetrated to a depth of 2 mm at a table speed of 2 cm/min at 30° C. by using a rheometer (product of Fudoh Kogyo). A cosmetic having a penetration hardness within the aforementioned range has a hardness that is easy to apply for a user without causing liquid dripping. "Semi-solid" refers to a state wherein the cosmetic is in a massive form but has poor shape retainability such that the cosmetic cannot be molded with a mold etc., and such a cosmetic is not used in a push-out container for containing stick-form cosmetics.

Figure 10A:
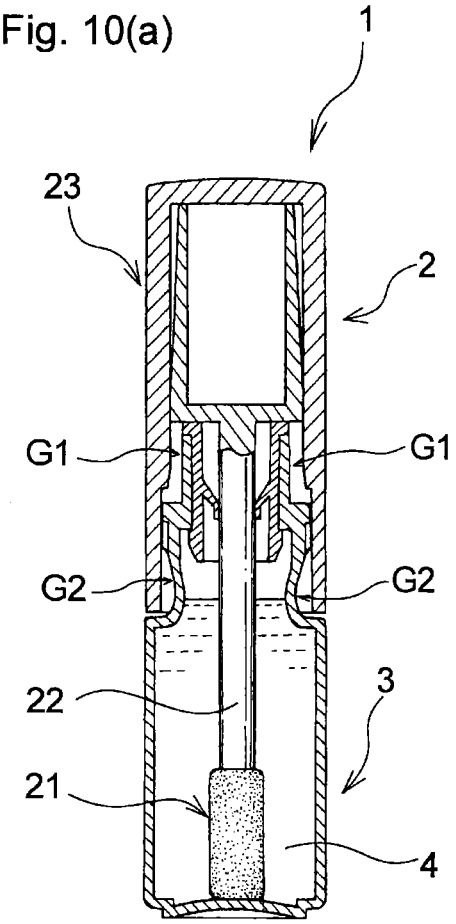
FIGS. 10(*a*) and 10(*b*) are figures illustrating yet another embodiment of the cosmetic application device of the present invention, wherein FIG. 10(*a*) is a figure corresponding to FIG. 1, and FIG. 10(*b*) is a figure corresponding to FIG. 5.
Figure 10B:
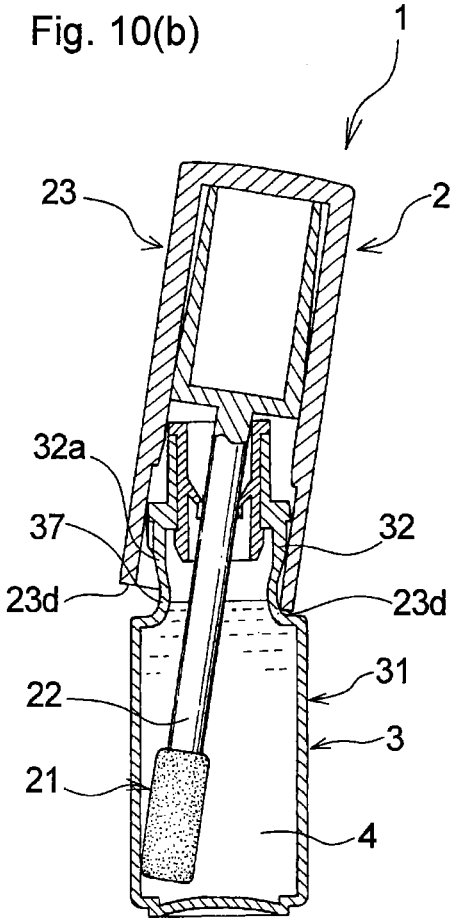

The present invention has been described above according to preferred embodiments thereof, but the present invention is not limited to the foregoing embodiments. For example, in the foregoing embodiment, the application section 21 connected to the front end of the support shaft 22 of the application tool 2 was sloped with respect to the direction in which the support shaft 22 extends, but instead, the direction in which the application section 21 extends may be parallel to the direction in which the support shaft 22 extends, as illustrated in FIGS. 10(*a*) and 10(*b*). The application section 21 illustrated in FIGS. 10(*a*) and 10(*b*) has a cylindrical shape whose height direction is in a direction parallel to the direction in which the support shaft 22 extends. The front end of the application section 21 is a circular flat surface that is orthogonal to the direction in which the support shaft 22 extends.

In relation to the foregoing embodiments, the present invention further discloses the following cosmetic application devices.

<1> A cosmetic application device comprising a cosmetic application tool for applying a cosmetic and a container for containing the cosmetic, the application tool being insertable into and removable from the container through an opening of the container, wherein:

the container includes: a substantially tubular containing section that has a bottom and that is for containing the cosmetic; and a substantially cylindrical mouth/neck section that is provided contiguously to the containing section and that has a smaller lateral cross-sectional area than the containing section;

the application tool includes: an application section for applying the cosmetic; a support shaft having a front end to which the application section is connected; and a lid body that is connected to a rear end of the support shaft and that is fixable to the mouth/neck section of the container in a state so as to cover the mouth/neck section;

in a state where the lid body is fixed to the mouth/neck section, a lower end section of the lid body is located at an upper end of the containing section;

when the application tool is tilted in a state where the fixation between the lid body and the mouth/neck section has been released and the lower end section of the lid body is located at a position within the height-wise length of the mouth/neck section, a front end of the application section of the application tool is made to contact an inner wall in the vicinity of the bottom section of the containing section of the container; and when the application tool is tilted in a state where the fixation between the lid body and the mouth/neck section has been released and the lower end section of the lid body is located at a position beyond an upper end of the mouth/neck section, the front end of the application section of the application tool is made to contact an inner wall of a shoulder section of the containing section of the container.

<2> The cosmetic application device according to the aforementioned item <1>, wherein, when the application tool is tilted in a state where the engagement between the lid body and the mouth/neck section has been released and the lower end section of the lid body is located at a position within the height-wise length of the mouth/neck section, the lower end section of the lid body does not contact the outer surface of the mouth/neck section, and the front end of the application section of the application tool is made to contact an inner wall in the vicinity of the bottom section of the containing section of the container.

<3> The cosmetic application device according to the aforementioned item <1>or <2>, wherein, in the mouth/neck section, a section close to the section which is contiguous to the containing section has a narrowed shape.

<4> The cosmetic application device according to any one of the aforementioned items <1>to <3>, wherein:

the mouth/neck section includes a lower tier section that is provided contiguously to the containing section, and an upper tier section that is provided contiguously to the upper end of the mouth/neck section's lower tier section and that has a smaller lateral cross-sectional area than the mouth/neck section'lower tier section; and a stepped section is formed between the mouth/neck section'lower tier section and the mouth/neck sectiom'upper tier section;

a lock mechanism that makes the mouth/neck section and the lid body engage with one another by rotating the lid body within a horizontal plane is provided to the stepped section; and the lock mechanism is made in such a manner that the height-wise position of the lid body dose not change at the time of engagement and disengagement between the mouth/neck section and the lid body caused by rotating the lid body within the horizontal plane.

<5> The cosmetic application device according to the aforementioned item <4>, wherein the stepped section is provided in a substantially central region of the mouth/neck section in the height direction of the mouth/neck section.

<6> The cosmetic application device according to any one of the aforementioned0 items <1> to <5>, wherein, when the application tool is tilted in a state where the engagement between the lid body and the mouth/neck section has been released and the lower end section of the lid body is located at a position beyond the upper end of the mouth/neck section, the tilting of the support shaft of the application tool is not restricted by the interior of the mouth/neck section, and the front end of the application section of the application tool is made to contact an inner wall in the vicinity of the upper end of the containing section of the container.

<7> The cosmetic application device according to any one of the aforementioned items <1> to <6>, wherein the application section of the application tool is sloped with respect to the support shaft of the application tool.

<8> The cosmetic application device according to any one of the aforementioned items <1> to <7>, wherein:

the application section includes a first surface which is an application surface, and a second surface located on the opposite side from the first surface;

a front end region of the application section has a protruding section that is protruded on the second surface side; and the front end region having the protruding section has a thickness that gradually increases from the front end of the application section toward the rear end of the application section and has a maximum thickness section, and the thickness of the front end region gradually decreases from the maximum thickness section toward the rear end of the application section.

<9> The cosmetic application device according to any one of the aforementioned items <1> to <8>, wherein a transparent section through which the cosmetic contained in the container is visible is provided to a side surface of the container.

<10> A lip cosmetic including a composition that has a penetration hardness of from 0.5 N to 100 N, inclusive, at 30° C. as measured with a 5-mm-dia. penetrator, the composition being filled into the cosmetic application device according to any one of the aforementioned items <1> to <9>.

<11> A cosmetic application device including a cosmetic application tool for applying a cosmetic and a container for containing the cosmetic, the application tool being insertable into and removable from the container through an opening of the container, wherein:

the container includes: a substantially tubular containing section that has a bottom and that is for containing the cosmetic; and a substantially cylindrical mouth/neck section that is provided contiguously to the containing section and that has a smaller lateral cross-sectional area than the containing section;

the application tool includes: an application section for applying the cosmetic; a support shaft having a front end to which the application section is connected; and a lid body that is connected to a rear end of the support shaft and that is fixable to the mouth/neck section of the container in a state so as to cover the mouth/neck section;

in a state where the lid body is fixed to the mouth/neck section, a lower end section of the lid body is located at an upper end of the containing section;

the mouth/neck section includes a lower tier section located on the containing section side, and an upper tier section located on the opening side; the mouth/neck section also includes a stepped section that is provided between the mouth/neck section's lower tier section and the mouth/neck section's upper tier section and that has the maximum outer diameter in the mouth/neck section;

in a state where the lid body is fixed to the mouth/neck section, a first clearance is formed between an upper end of the mouth/neck section's upper tier section and an upper-end inner wall of the lid body, and a second clearance is formed between a lower end of the mouth/neck section's lower tier section and a lower-end inner wall of the lid body;

in the mouth/neck section's lower tier section, a section close to the containing section has a narrowed shape, and the mouth/neck section's lower tier section has a lateral cross-sectional area that gradually decreases from an upper section thereof toward the containing section; and when the application tool is tilted in a state where the fixation between the lid body and the mouth/neck section has been released and the lower end section of the lid body is located at a position within the height-wise length of the mouth/neck section, the application section of the application tool is made to contact an inner wall in the vicinity of the bottom section of the containing section of the container.

<12> The cosmetic application device according to the aforementioned item <11>, wherein the stepped section is provided in a substantially central region of the mouth/neck section in the height direction thereof; and the stepped section is located at a position that is preferably from 40% to 60% inclusive, and more preferably from 45% to 55% inclusive, from the lower end of the mouth/neck section with respect to the height of the mouth/neck section.

<13> The cosmetic application device according to the aforementioned item <11> or <12>, wherein an engagement section for engagement between the lid body and the mouth/neck section is provided to the stepped section.

<14> The cosmetic application device according to the aforementioned item <13>, the engagement section is constituted by a lock mechanism that makes the mouth/neck section and the lid body engage with one another by rotating the lid body within a horizontal plane; and the lock mechanism is made in such a manner that the height-wise position of the lid body does not change at the time of engagement and disengagement between the mouth/neck section and the lid body caused by rotating the lid body within the horizontal plane.

<15> The cosmetic application device according to the aforementioned item <14>, wherein: the lock mechanism includes an engagement pawl; and the engagement pawl is constructed so as to be engageable with a protrusion that is formed on the inner wall of a lid trunk wall section of the lid body.

<16> The cosmetic application device according to any one of the aforementioned items <13> to <15>, wherein: a plurality of the engagement sections are provided; a plurality of the engagement sections are arranged at even intervals along the circumferential direction of the mouth/neck section; and preferably, two lock mechanisms are arranged so as to be in a positional relationship in which they are separated by 180 degrees.

<17> The cosmetic application device according to any one of the aforementioned items <11> to <16>, wherein, when the application tool is tilted in a state where the fixation between the lid body and the mouth/neck section has been released and the lower end section of the lid body is located at a position beyond an upper end of the mouth/neck section, a front end of the application section of the application tool is made to contact an inner wall of a shoulder section of the containing section of the container.

<18> The cosmetic application device according to any one of the aforementioned items <11> to <17>, wherein the application section of the application tool is sloped with respect to the support shaft of the application tool.

<19> The cosmetic application device according to any one of the aforementioned items <11> to <18>, wherein:

the application section includes a first surface which is an application surface, and a second surface located on the opposite side from the first surface;

a front end region of the application section has a protruding section that is protruded on the second surface side; and the front end region having the protruding section has a thickness that gradually increases from the front end of the application section toward the rear end of the application section and has a maximum thickness section, and the thickness of the front end region gradually decreases from the maximum thickness section toward the rear end of the application section.

<20> The cosmetic application device according to any one of the aforementioned items <11> to <17>, wherein the direction in which the application section of the application tool extends is parallel to the direction in which the support shaft of the application tool extends.

<21> The cosmetic application device according to any one of the aforementioned items <11> to <20>, wherein a transparent section through which the cosmetic contained in the container is visible is provided to a side surface of the container.

<22> The cosmetic application device according to any one of the aforementioned items <11> to <21>, wherein:

a squeezing member is attached to the mouth/neck section's upper tier section of the container;

the squeezing member includes a squeezing valve that extends downward; and if the height from an inner surface of the bottom section of the containing section of the container to the squeezing valve is defined as H1 and the radius of the containing section is defined as R1, then the value H1/R1 is preferably from 1 to 6 inclusive, and more preferably from 2 to 5 inclusive.

<23> The cosmetic application device according to any one of the aforementioned items <11> to <22>, wherein, if the height from an inner surface of the bottom section of the containing section of the container to the upper end of the containing section is defined as H2 and the radius of the containing section is defined as R1, then the value H2/R1 is preferably from 1 to 4 inclusive, and more preferably from 1.5 to 3.5 inclusive.

<24> The cosmetic application device according to any one of the aforementioned items <11> to <23>, wherein, if the inner diameter of the squeezing member of the container is defined as Ds and the minimum inner diameter of the mouth/neck section's lower tier section is defined as Dk, then the value Dk/Ds is preferably from 1 to 3 inclusive, and more preferably from 1.2 to 1.8 inclusive.

<25> The cosmetic application device according to any one of the aforementioned items <11> to <24>, wherein, if the inner diameter of the containing section of the container is defined as Db and the minimum inner diameter of the mouth/neck section's lower tier section is defined as Dk, then the value Db/Dk is preferably from 1 to 3 inclusive, and more preferably from 1.4 to 2 inclusive.

<26> A lip cosmetic including a composition that has a penetration hardness of from 0.5 N to 100 N, inclusive, at 30° C. as measured with a 5-mm-dia. penetrator, the composition being filled into the cosmetic application device according to any one of the aforementioned items <11> to <25>.

INDUSTRIAL APPLICABILITY

With the present invention, it is possible to efficiently scrape off the cosmetic adhering to and remaining on the inner surface of the container body, and to completely use up the cosmetic without waste.

The invention claimed:

1. A cosmetic application device comprising a cosmetic application tool for applying a cosmetic and a container for containing the cosmetic, the application tool being insertable into and removable from the container through an opening of the container, wherein:

the container includes:

a substantially tubular containing section that has a bottom and that is for containing the cosmetic; and a substantially cylindrical mouth/neck section that is provided contiguously to the containing section and that has a smaller lateral cross-sectional area than the containing section;

the application tool includes:

an application section for applying the cosmetic;

a support shaft having a front end to which the application section is connected; and a lid body that is connected to a rear end of the support shaft and that is fixable to the mouth/neck section of the container in a state so as to cover the mouth/neck section;

in a state where the lid body is fixed to the mouth/neck section, a lower end section of the lid body is located at an upper end of the containing section;

the mouth/neck section includes a lower tier section located on the containing section side, and an upper tier section located on the opening side;

the mouth/neck section also includes a stepped section that is provided between the mouth/neck section's lower tier section and the mouth/neck section's upper tier section and that has the maximum outer diameter in the mouth/neck section;

the stepped section is provided in a substantially central region of the mouth/neck section in a height direction of the mouth/neck section;

a plurality of engagement sections for engagement between the lid body and the mouth/neck section is provided to the stepped section;

the plurality of the engagement sections are arranged at even intervals along the circumferential direction of the mouth/neck section;

in a state where the lid body is fixed to the mouth/neck section, a first clearance is formed between an upper end of the mouth/neck section's upper tier section and an upper-end inner wall of the lid body, and a second clearance is formed between a lower end of the mouth/neck section's lower tier section and a lower-end inner wall of the lid body;

in the mouth/neck section's lower tier section, a section close to the containing section has a narrowed shape, and the mouth/neck section's lower tier section has a lateral cross-sectional area that gradually decreases from an upper section thereof toward the containing section;

when the application tool is tilted in a state where the fixation between the lid body and the mouth/neck section has been released and the lower end section of the lid body is located at a position within a height-wise length of the mouth/neck section, the application section of the application tool is made to contact an inner wall in the vicinity of the bottom section of the containing section of the container; and the cosmetic application device has filled therein a lip cosmetic, as the cosmetic, comprising a composition that has a penetration hardness of from 0.5 N to 100 N, inclusive, at 30° C. as measured with a 5-mm-dia. penetrator.

2. The cosmetic application device according to claim 1, wherein:

the engagement section is constituted by a lock mechanism that makes the mouth/neck section and the lid body engage with one another by rotating the lid body within a horizontal plane; and the lock mechanism is made in such a manner that the height-wise position of the lid body does not change at the time of engagement and disengagement between the mouth/neck section and the lid body caused by rotating the lid body within the horizontal plane.

3. The cosmetic application device according to claim 1, wherein, when the application tool is tilted in a state where the fixation between the lid body and the mouth/neck section has been released and the lower end section of the lid body is located at a position beyond an upper end of the mouth/neck section, a front end of the application section of the application tool is made to contact an inner wall of a shoulder section of the containing section of the container.

4. The cosmetic application device according to claim 1, wherein the application section of the application tool is sloped with respect to the support shaft of the application tool.

5. The cosmetic application device according to claim 1, wherein:

the application section includes a first surface which is an application surface, and a second surface located on the opposite side from the first surface;

a front end region of the application section has a protruding section that is protruded on the second surface side; and the front end region having the protruding section has a thickness that gradually increases from the front end of the application section toward the rear end of the application section and has a maximum thickness section, and the thickness of the front end region gradually decreases from the maximum thickness section toward the rear end of the application section.

6. The cosmetic application device according to claim 1, wherein a direction in which the application section of the application tool extends is parallel to a direction in which the support shaft of the application tool extends.

7. The cosmetic application device according to claim 1, wherein:

a squeezing member is attached to the mouth/neck section's upper tier section of the container;

the squeezing member includes a squeezing valve that extends downward; and a height from an inner surface of the bottom section of the containing section of the container to the squeezing valve is defined as H1 and a radius of the containing section is defined as R1, such that a value H1/R1 is from 1 to 6, inclusive.

8. The cosmetic application device according to claim 1, wherein a height from an inner surface of the bottom section of the containing section of the container to the upper end of the containing section is defined as H2 and a radius of the containing section is defined as R1, such that a value H2/R1 is from 1 to 4, inclusive.

9. The cosmetic application device according to claim 7, wherein an inner diameter of the squeezing member of the container is defined as Ds and a minimum inner diameter of the mouth/neck section's lower tier section is defined as Dk, such that a value Dk/Ds is from 1 to 3 inclusive.

10. The cosmetic application device according to claim 1, wherein an inner diameter of the containing section of the container is defined as Db and a minimum inner diameter of the mouth/neck section's lower tier section is defined as Dk, such that a value Db/Dk is from 1 to 3 inclusive.

11. The cosmetic application device according to claim 1, wherein a transparent section through which the cosmetic contained in the container is visible is provided to a side surface of the container.

12. A cosmetic application device comprising a cosmetic application tool for applying a cosmetic and a container for containing the cosmetic, the application tool being insertable into and removable from the container through an opening of the container, wherein:

the container includes:

a substantially tubular containing section that has a bottom and that is for containing the cosmetic; and a substantially cylindrical mouth/neck section that is provided contiguously to the containing section and that has a smaller lateral cross-sectional area than the containing section;

the application tool includes:

an application section for applying the cosmetic;

a support shaft having a front end to which the application section is connected; and a lid body that is connected to a rear end of the support shaft and that is fixable to the mouth/neck section of the container in a state so as to cover the mouth/neck section;

in a state where the lid body is fixed to the mouth/neck section, a lower end section of the lid body is located at an upper end of the containing section;

the mouth/neck section includes a lower tier section located on the containing section side, and an upper tier section located on the opening side;

the mouth/neck section also includes a stepped section that is provided between the mouth/neck section's lower tier section and the mouth/neck section's upper tier section and that has the maximum outer diameter in the mouth/neck section;

the stepped section is provided in a substantially central region of the mouth/neck section in a height direction of the mouth/neck section;

a plurality of engagement sections for engagement between the lid body and the mouth/neck section is provided to the stepped section;

the plurality of the engagement sections are arranged at even intervals along the circumferential direction of the mouth/neck section;

in a state where the lid body is fixed to the mouth/neck section, a first clearance is formed between an upper end of the mouth/neck section's upper tier section and an upper-end inner wall of the lid body, and a second clearance is formed between a lower end of the mouth/neck section's lower tier section and a lower-end inner wall of the lid body;

in the mouth/neck section's lower tier section, a section close to the containing section has a narrowed shape, and the mouth/neck section's lower tier section has a lateral cross-sectional area that gradually decreases from an upper section thereof toward the containing section;

when the application tool is tilted in a state where the fixation between the lid body and the mouth/neck section has been released and the lower end section of the lid body is located at a position within a height-wise length of the mouth/neck section, the application section of the application tool is made to contact an inner wall in the vicinity of the bottom section of the containing section of the container;

the engagement section is constituted by a lock mechanism that makes the mouth/neck section and the lid body engage with one another by rotating the lid body within a horizontal plane; and the lock mechanism is made in such a manner that the height-wise position of the lid body does not change at the time of engagement and disengagement between the mouth/neck section and the lid body caused by rotating the lid body within the horizontal plane.

13. The cosmetic application device according to claim 12, wherein, when the application tool is tilted in a state where the fixation between the lid body and the mouth/neck section has been released and the lower end section of the lid body is located at a position beyond an upper end of the mouth/neck section, a front end of the application section of the application tool is made to contact an inner wall of a shoulder section of the containing section of the container.

14. The cosmetic application device according to claim 12, wherein the application section of the application tool is sloped with respect to the support shaft of the application tool.

15. The cosmetic application device according to claim 12, wherein:

the application section includes a first surface which is an application surface, and a second surface located on the opposite side from the first surface;

a front end region of the application section has a protruding section that is protruded on the second surface side; and the front end region having the protruding section has a thickness that gradually increases from the front end of the application section toward the rear end of the application section and has a maximum thickness section, and the thickness of the front end region gradually decreases from the maximum thickness section toward the rear end of the application section.

16. The cosmetic application device according to claim 12, wherein a direction in which the application section of the application tool extends is parallel to a direction in which the support shaft of the application tool extends.

17. The cosmetic application device according to claim 12, wherein:

a squeezing member is attached to the mouth/neck section's upper tier section of the container;

the squeezing member includes a squeezing valve that extends downward; and a height from an inner surface of the bottom section of the containing section of the container to the squeezing valve is defined as H1 and a radius of the containing section is defined as R1, such that a value H1/R1 is from 1 to 6, inclusive.

18. The cosmetic application device according to claim 12, wherein a height from an inner surface of the bottom section of the containing section of the container to the upper end of the containing section is defined as H2 and a radius of the containing section is defined as R1, such that a value H2/R1 is from 1 to 4, inclusive.

19. The cosmetic application device according to claim 17, wherein an inner diameter of the squeezing member of the container is defined as Ds and a minimum inner diameter of the mouth/neck section's lower tier section is defined as Dk, such that a value Dk/Ds is from 1 to 3 inclusive.

20. The cosmetic application device according to claim 12, wherein an inner diameter of the containing section of the container is defined as Db and a minimum inner diameter of the mouth/neck section's lower tier section is defined as Dk, such that a value Db/Dk is from 1 to 3 inclusive.

21. The cosmetic application device according to claim 12, wherein a transparent section through which the cosmetic contained in the container is visible is provided to a side surface of the container.

* * * * *